US011326316B1

(12) United States Patent
Condello

(10) Patent No.: US 11,326,316 B1
(45) Date of Patent: May 10, 2022

(54) SNOW PLOW CUTTING EDGE DEVICE AND CUTTING EDGE ATTACHMENTS

(71) Applicant: Northern Supply II, Inc., Bloomfield, NY (US)

(72) Inventor: Kelly Condello, Bloomfield, NY (US)

(73) Assignee: Northern Supply II, Inc., Bloomfield, NY (US)

( * ) Notice: Subject to any disclaimer, the term of this patent is extended or adjusted under 35 U.S.C. 154(b) by 0 days.

(21) Appl. No.: 17/480,460

(22) Filed: Sep. 21, 2021

Related U.S. Application Data

(60) Provisional application No. 63/241,245, filed on Sep. 7, 2021.

(51) Int. Cl.
*E01H 5/06* (2006.01)

(52) U.S. Cl.
CPC ..... *E01H 5/066* (2013.01)

(58) Field of Classification Search
CPC ..... E01H 5/066; E01H 5/065; E01H 5/06; E01H 5/061; E01H 5/062; E01H 5/063
See application file for complete search history.

(56) References Cited

U.S. PATENT DOCUMENTS

| | | | | |
|---|---|---|---|---|
| 7,101,709 | B2 | 9/2006 | Weiss et al. | |
| 7,631,441 | B2 | 12/2009 | Hunt | |
| 9,611,604 | B2 | 4/2017 | Vigneault | |
| 10,865,533 | B2 | 12/2020 | Stephan | |
| 10,865,534 | B2 * | 12/2020 | Martin | E01H 5/062 |
| 11,124,935 | B2 * | 9/2021 | Martin | E01H 5/062 |
| 2015/0376850 | A1 * | 12/2015 | Giletta | E01H 5/066 37/233 |
| 2018/0327989 | A1 * | 11/2018 | Stephan | E01H 5/062 |
| 2019/0136473 | A1 * | 5/2019 | Desrochers | E01H 5/061 |
| 2019/0177939 | A1 * | 6/2019 | Guggino | E01H 5/12 |
| 2019/0203436 | A1 * | 7/2019 | Martin | E01H 5/062 |

OTHER PUBLICATIONS

"Valley Blades Polar Flex"; DionCo Sales; www.dioncosales.com/Polar-Flex.html.

* cited by examiner

*Primary Examiner* — Jamie L McGowan
(74) *Attorney, Agent, or Firm* — Woods Oviatt Gilman LLP; Dennis B. Danella, Esq.

(57) ABSTRACT

A cutting edge attachment including a cover retaining plate and a cutting edge is provided. The cover retaining plate includes through-hole bushings extending outward for receiving a corresponding number of fasteners to mount the cutting edge to an adapter plate. The cutting edge includes elongated openings for receiving the bushings, a top edge having notches for receiving springs, and a bottom edge. The cover retaining plate is configured to secure the cutting edge to the adapter plate using fasteners inserted through the bushings, the elongated openings of the cutting edge, and holes defined in the adapter plate. The springs are disposed between the notches and a top edge extension of the cover retaining plate and configured to compress in the vertical direction. The cutting edge is configured to move vertically as the bushings travel within the elongated openings when an upward force is applied to the cutting edge.

20 Claims, 9 Drawing Sheets

SNOW PLOW CUTTING EDGE DEVICE AND CUTTING EDGE ATTACHMENTS

CROSS-REFERENCE TO RELATED APPLICATIONS

This application claims the benefit of U.S. Patent Application No. 63/241,245, filed Sep. 7, 2021, the contents of which are hereby incorporated in its entirety.

FIELD OF THE INVENTION

The present invention generally relates to a cutting edge attachment for snow and ice removal, and more particularly to a snow plow cutting edge device including a plurality of cutting edge attachments that may be mounted to a snow plow.

BACKGROUND OF THE INVENTION

Traditional snow plows have a fixed edge that operates to scrape the road surface to remove snow and ice from the road to provide improved road conditions. A fixed blade arrangement has certain drawbacks in that it provides a straight bottom edge to move the snow material from the road, but in practice does not perform well because road surfaces are not typically flat. Roads are oftentimes designed with cambered surfaces to provide for drainage, and over time, settle in certain spots due to the repeated weight imposed in the road by vehicle travel. Moreover, road surfaces also have manholes, utility lids, or other obstacles in the road which leads to sub-par snow material from the road. When snow remains on the road, municipalities are forced to use salt to clear the roads of the snow material that is left behind by the snow plows, which has a negative environmental effect on the local water table, streams and lakes. Uneven road surfaces not only result in sub-par snow material from the road, but also subject cutting edge arrangements to extensive wear and tear. Repair or replacement of worn cutting edges or entire snow plows can be costly. To address these issues, there are certain devices that are attached to the bottom edge of a snow plow that attempt to provide for some uneven surfaces in the road. However, some of these existing systems are either not effective at conforming to the road surface, are complicated mechanical devices, or are difficult to install or maintain.

Thus, what is needed is a snow plow cutting edge device where each of the cutting edge attachments are independently removable and replaceable, can be easily installed without modifying existing snow plows, moldboards and/or vehicles, and can operate to retract and contour to variable road surfaces independently of the other cutting edge attachments along the length of the snow plow.

SUMMARY OF THE INVENTION

The present invention addresses the above needs by providing a snow plow cutting edge device for use with a snow plow, wherein the snow plow includes a moldboard, the snow plow cutting edge. The cutting edge device comprises an adapter plate configured to mount to the moldboard of the snow plow, wherein the adapter plate includes a plurality of apertures defined therein. The cutting edge device further comprises a plurality of cutting edge attachments and a plurality of fasteners for attaching each of the plurality of cutting edge attachments to the adapter plate. Each of the cutting edge attachments include a cover retaining plate, a plurality of springs, and a cutting edge. Each of the cutting edge attachments includes a cover retaining plate, a plurality of springs, and a cutting edge. The cover retaining plate includes a back plate, a top edge extension, and a pair of through-hole bushings extending outward from the back plate. The cutting edge includes a pair of elongated openings defined therein, wherein each of the elongated openings receive one of the pair of through-hole bushings, wherein a plurality of notches are defined in a top edge of the cutting edge, wherein the cutting edge includes a bottom edge configured for engaging a road surface during operation of the snow plow. Each of the plurality of springs include a first end and a second end, wherein the first end is disposed in a corresponding one of the plurality of notches, and wherein the send end is disposed against the top edge extension of the cover retaining plate. Each of the plurality of fasteners are disposed in one of the pair of through-hole bushings and a corresponding one of the plurality of apertures defined in the adapter plate to secure the respective cutting edge attachment to the adapter plate. The pair of through-hole bushings are positioned within the corresponding elongated pair of elongated openings defined in the cutting edge so that the cutting edge is movably secured between the cover retaining plate and the adapter plate, and wherein the plurality of springs bias the cutting edge toward the road surface so that the bottom edge of the cutting edge maintains contact with the road surface.

In some example embodiments, the springs of a respective cutting edge attachment are configured to compress, and the cutting edge of the respective cutting edge attachment is configured to slidably move up and/or down or on a tilt independently of other cutting edges of other cutting edge attachments that are connected to the adapter plate.

In some example embodiments, the springs of a respective cutting edge attachment and the cutting edge of the respective cutting edge attachment are configured to be installed, removed, repaired, and/or replaced independently of other springs and other cutting edges of other cutting edge attachments that are connected to the adapter plate.

In some example embodiments, each of the cover retaining plates includes a first portion that is a flat plate, with holes through which the pair of through-hole bushings protrude outward from the back surface of the cover retaining plate, a second portion that is a bent or angled plate, including a flat middle section and an angled bottom section, with holes in the middle section through which the pair of through-holes protrude, and the top edge extension that is a flat thin plate that is arranged perpendicular to the first portion and the middle section of the second portion.

In some example embodiments, the top edge extension is integrated with the second portion, such that the top edge extension is a top section of the second portion, or the top edge extension is a separate and distinct plate relative to the first and second portions of the cover retaining plate.

In some example embodiments, the second portion of the cover retaining plate includes a first side extension that protrudes outwardly from the first end of the first portion of the cover retaining plate, and the top edge extension includes a second side extension that protrudes outwardly from the second end of the first portion.

In some example embodiments, the first side extension of the second portion is configured to overlap with the second side extension of the top edge extension of another cover retaining plate of another cutting edge attachment that is adjacent to the respective cutting edge attachment.

In some example embodiments, each of the plurality of notches have a similar configuration.

In some example embodiments, the top edge extension includes a bottom surface, and wherein the top edge extension includes a plurality of support posts extending downward from the bottom surface, and wherein each of the plurality of support posts are disposed in a corresponding one of the plurality of springs.

In some example embodiments, per cutting edge attachment, there are at least one inner spring and corresponding notch and at least two outer springs and corresponding notches, and the inner springs and corresponding notches may be the same as or different from the outer springs and corresponding notches.

Some other example embodiments provide a cutting edge attachment for connection to an adapter plate mountable to a moldboard of a snow plow, the cutting edge attachment including the cover retaining plate, the plurality of springs, and the cutting edge as described above.

Some other example embodiments provide a snow plow comprising the adapter plate and the plurality of cutting edge attachments as described above.

In another aspect, a cutting edge attachment for connection to an adapter plate mountable to a moldboard of a snow plow is provided. The cutting edge attachment comprises a cover retaining plate, a plurality of springs, and a cutting edge. The cover retaining plate includes a back plate, a top edge extension, and a pair of through-holes extending outward from the back plate. The plurality of springs each include a first end and a second end, wherein the first end of each of the plurality of springs is disposed against the top edge extension of the cover retaining plate. The cutting edge includes a pair of elongated openings defined therein, wherein each of the elongated openings receive one of the pair of through-hole bushings, The cutting edge further includes a top edge having a plurality of notches defined therein, wherein each of the plurality of notches receive the second end of one of the plurality of springs. The cutting edge further includes a bottom edge configured for engaging a road surface during operation of the snow plow. The pair of through-holes are configured for receiving a corresponding number of fasteners that operate to secure the cutting edge attachment to the adapter plate so that the cutting edge is movably secured between the cover retaining plate and the adapter plate. The plurality of springs operate to bias the cutting edge toward the road surface so that the bottom edge of the cutting edge maintains contact with the road surface.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

The present invention is described below in enabling detail by the following examples, which may represent more than one example embodiment of the present invention.

Figure 1:
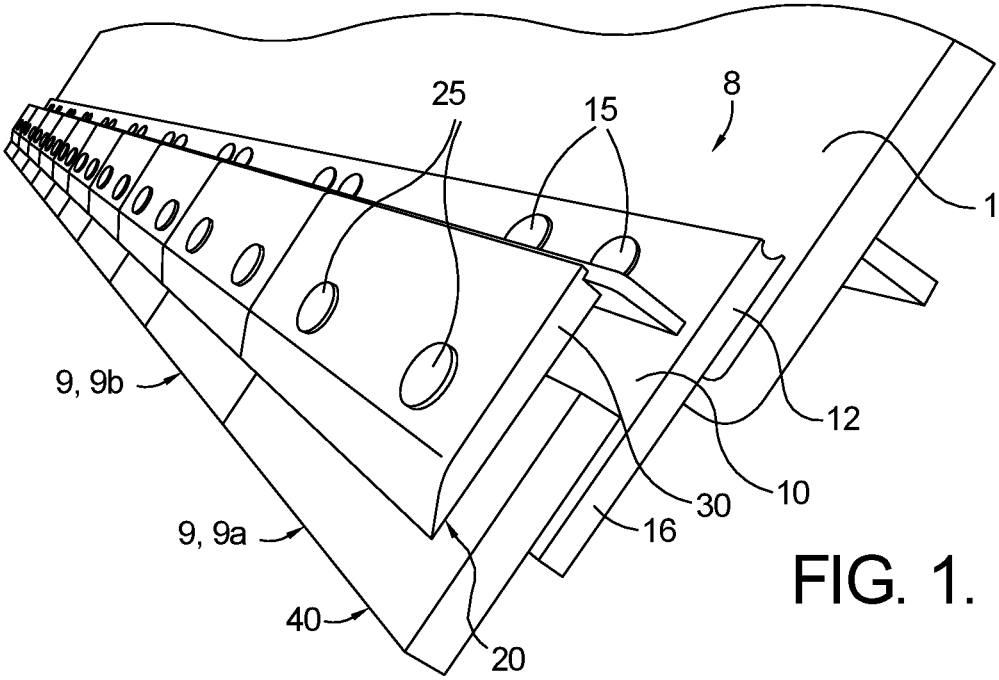
FIG. 1 is a front perspective view of a snow plow cutting edge device including a plurality of cutting edge attachments, according to an example embodiment.

Turning now to the drawings, with initial reference to FIG. 1, one exemplary embodiment of a snow plow cutting edge device including a plurality of cutting edge attachments is provided and is identified with reference numeral 8. As shown in FIG. 1, snow plow cutting edge device 8 includes an adapter plate 10 and a plurality of cutting edge attachments 9. Each cutting edge attachment 9 includes a cover retaining plate 20, springs 30, and a cutting edge 40.

In some example embodiments, adapter plate 10 is a single long rectangular plate. An upper portion 12 of adapter plate 10 has bolt holes 14 defined therein that are designed to align with bolt holes 4 (FIGS. 5-6) of a moldboard 1 of a snow plow configured for mounting on the front of a truck or other vehicle. The design and mechanisms for attachment of the moldboard 1 to the front end of the truck or other vehicle may be various standard means known in the industry. Bolts 15 may be inserted through bolt holes 14 in upper portion 12 of adapter plate 10 and bolt holes 4 of the moldboard 1 to mount adapter plate 10 to plow moldboard 1. A lower portion 16 of adapter plate 10 has bolt holes 18 defined therein that are designed to align with, or accept, bolt through-hole bushings 28 of cover retaining plate 20. Bolts 25 may be inserted through respective through-hole bushings 28 of cover retaining plate 20, elongated openings 48 of cutting edge 40, and bolt holes 18 in lower portion 16 of adapter plate 10 to attach cutting edge 40 to the adapter plate 10 via cover retaining plate 20. During assembly, the various bolts may be secured via nuts, washers, and other commonly used fastening means. Bolts may be the same sizes or different widths and/or lengths, as needed or desired for structural support, stability, and durability.

The length of adapter plate 10 may be designed to correspond to various standard sizes of snow plows, extending the entire length (or most) of moldboard 1 of the snow plow. In some other example embodiments, adapter plate 10 may comprise multiple plates in a row, so as to provide a modular design of varying lengths. Also refer to FIGS. 5-6, 10, and 12 regarding adapter plate 10.

For each cutting edge attachment 9 of snow plow cutting edge device 8, cover retaining plate 20 attaches or otherwise retains cutting edge 40 to adapter plate 10. The springs 30 allow each cutting edge 40 to slidably move generally perpendicularly to the road surface (or on a slight tilt/angle relative to the road surface) during operation to adjust to varying road conditions independently of other cutting edges 40 of the other cutting edge attachments 9 mounted to adapter plate 10. Additional details of cover retaining plate 20, springs 30, and cutting edge 40 will be described below with reference to FIGS. 2-4.

Figure 2:
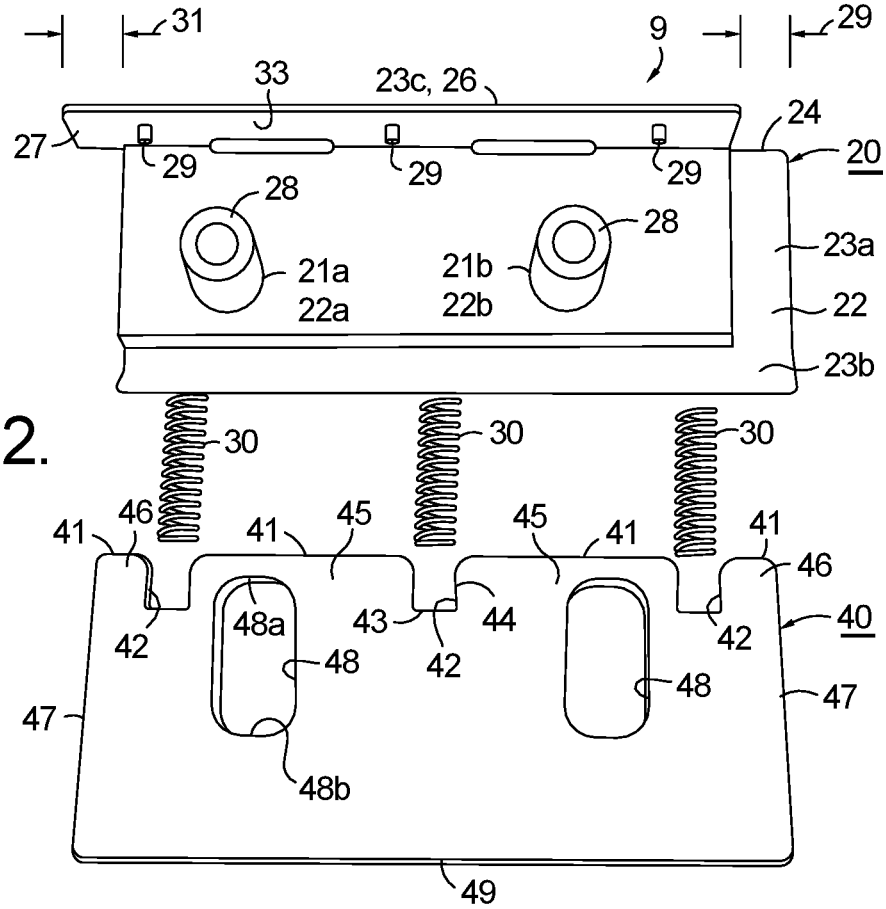
FIG. 2 is an exploded rear view showing disassembled components of a single cutting edge attachment, according to an example embodiment.

FIG. 2 is an exploded rear view showing disassembled components of a single cutting edge attachment, according to an example embodiment. As shown in FIG. 2 and mentioned above, each cutting edge attachment 9 includes cover retaining plate 20, springs 30, and cutting edge 40. Each of these elements, along with their arrangements and interactions with respect to each other, will be further described in detail below. Also refer to FIGS. 7-9 below for details of each element of the cutting edge attachments and their relationships to each other.

Cover retaining plate 20 secures or otherwise retains cutting edge 40 to the adapter plate 10, wherein cutting edge 40 is movably disposed between cover retaining plate 20 and adapter plate 10. The cover retaining plate 20 also holds the springs 30 in place once assembled, and during operation of the snow plow cutting edge device 8. The cover retaining plate 20 includes a first portion 21, a second portion 22, a third portion 26, and a pair of through-hole bushings 28. It should be understood that first and second portions 21, 22 may collectively be referred to herein as a back plate. First portion 21 may be a flat rectangular plate, with holes 21*a*, 21*b* through which pair of through-hole bushings 28 protrude outward from the back surface of the cover retaining plate 20, where the through-hole bushings 28 can receive bolts 25 during assembly of the snow plow cutting edge device 8.

Second portion 22 may be including a flat rectangular middle section 23*a* and an angled rectangular bottom section 23*b*, with holes 22*a*, 22*b* in middle section 23*a* through which through-hole bushings 28 protrude outward from the back surface of the cover retaining plate 20. The angle at which second portion 22 is bent to form middle section 23*a* and bottom section 23*b* may be diagonal (about 45 degrees, although this is non-limiting and the angle may be greater or less than 45 degrees). Bottom section 23*b* includes a distal edge that is angled toward, and positioned adjacent to or in contact with, cutting edge 40. This distal edge may operate to guide or otherwise maintain the path of travel of cutting edge 40 as it moves linearly between cover retaining plate 20 and adapter plate 10. Second portion 22 (middle section 23*a* and bottom section 23*b*) includes a top edge extension 24 that protrudes out a distance 29 from the side of the opposite side of the first portion 21 (right side in FIG. 2). Note that the opposite side of second portion 22 from extension 24 is flush with the opposite side of the first portion 21 (left side in FIG. 2).

Third portion 26 may be a flat rectangular plate that is arranged perpendicular to first portion 21 and middle section 23*a* of second portion 22. Third portion 26 includes an extension 27 that protrudes a distance 31 out from the side of first portion 21 and second portion 22 (left side in FIG. 2). Note that the opposite side of third portion 26 from extension 27 is flush with the opposite side of first portion 21 (right side in FIG. 2).

In some example embodiments, third portion 26 may be integrated with second portion 22. For example, middle section 23*a* of second portion 22, bottom section 23*b* of the second portion 22, and third portion 26 (which may also be considered a top edge extension 23*c* of second portion 22 in this example embodiment) may be formed by cutting out a section at the left side of middle section 23*a* and bottom section 23*b* of second portion 22 (so as to form a long rectangular vertical cutout or notch) and cutting out a section at the upper right corner of middle section 23*a* and third portion 26 (top section 23*a*)(so as to form a square or short rectangular cutout or notch), and then bending the single piece of metal at upper and lower portions to the appropriate or desired angles for bottom section 23*a* and third portion 26 (23*b*). The vertical distance between the two bends (the bend between bottom section 23*b* and middle section 23*a*, and the bend between top edge extension 23*c* and middle section 23*b*) corresponds to the vertical width of first portion 21, as shown in FIG. 2. Thus, first portion 21 may lay against middle section 23*a* of second portion 22, and bottom section 23*b* and third portion 26 (top edge extension 23*c*) may wrap around first portion 21 at diagonal and right angles, respectively. Second portion 22 may be welded to first portion 21 at or near the lower bend between middle section 23*a* and bottom section 23*b* of second portion 22, and third portion 26 (top edge extension 23*c*) may be welded to first portion 21 at or near the upper bend between middle section 23*a* and third portion 26 (top edge extension 23*c*), for example. Various known suitable attachment/fixing mechanisms for the components of cover retaining plate 20 other than welding are also possible, according to some other example embodiments.

However, in an alternative example embodiment, third portion 26 may be a separate and distinct metal plate welded to second portion 22 and/or first portion 21 at a right angle (about 90 degrees) so as to be attached perpendicular thereto. In this alternative example embodiment, there is no need to form the cutouts or notches in cover retaining plate 20 itself, and an opening corresponding to extension 24 of second portion 22 (extending past the right side of first portion 21) and an opening corresponding to extension 27 of third portion 26 (extending out past the left side of first portion 21 and second portion 22) are formed simply by the respective alignments of the individual pieces of cover retaining plate 20 including first portion 21, second portion 22, and third portion 26 when welding the pieces together (or otherwise attaching/fixing them to form cover retaining plate 20).

The extension 27 of third portion 26 (top edge extension 23*c*) of cover retaining plate 20 corresponds in size to and is designed to engage with a cutout or notch (or opening in the alternative embodiment above) on the side of an adjacent cutting edge attachment 9 of the snow plow cutting edge device 8. Likewise, the cutout or notch (or opening in the alternative embodiment above) above extension 24 of middle section 23*a* and bottom section 23*b* of cover retaining plate 20 corresponds in size to and is designed to engage with an extension of a third portion/top section on the side of an adjacent cutting edge attachment 9 of the snow plow cutting edge device 8.

Thus, each cover retaining plate 20 is design to partially overlap with adjacent cover retaining plates on either side when assembled into a row of a plurality of cutting edge attachments that are mounted to adapter plate 10. This can assist with easy alignment of the cutting edge attachments and bolt holes during assembly of the snow plow cutting edge device and provides for increased rigidity of snow plow cutting edge device 8 as a whole.

Third portion 26 (top edge extension 23*c*) also includes a plurality of support posts 29 extending down from a bottom surface 33 thereof that are designed to receive and maintain the position of springs 30. In particular, a top part of springs 30 slides over and around, and engages with, support posts 29, respectively. Support posts 29 are configured to secure springs 30 during assembly of the cutting edge attachments and prevent lateral movement of springs 30 during operation of the snow plow cutting edge device.

Springs 30 allow cutting edge 40 of each cutting edge attachment 9 to fluctuate with the road surface during operation of the snow plow cutting edge device 8. Springs 30 may be die springs or other similar CNC-machined compression springs, for example. Springs 30 may be formed using various kinds of metals as commonly known in the industry, and may have a cylindrical, squared, or rectangular shape, for example, with at least one open end (the top end corresponding to support posts 29). However, example embodiments are not limited thereto, and various other types of compression springs or other flexible spring-like mechanisms may be utilized. Alternatively, springs 30 may be made of flexible polymer or elastomer materials, for example. Springs 30 may have coils, or may be solid or molded, or may be rubberized hollow cylindrical or tube-like structures. Each spring 30 may be identical, but this is not required and some springs may have different lengths, widths, compressive strengths, shapes, or the like as compared to each other, to allow for varying degrees and forces required for retraction of cutting edge 40 during operation of the snow plow cutting edge device according to different design needs or desires. Also, springs 30 may be linear or constant rate springs, progressive or variable rate springs, dual or fast/soft rate springs, etc. Springs 30 may be standard off-the-shelf springs widely available and commonly used in the industry, or custom-designed components for different applications.

Although three springs 30 are shown in the figures, some other example embodiments are not limited thereto, and there may be a greater or lesser number of springs per cutting edge attachment. For example, there may be only two outer springs or a single inner spring, or there may be a pair in inner springs and a pair of outer springs. In the case of fewer than three springs the springs may be larger and/or may have more resistance, and in the case of more than three springs the springs may be smaller and/or may have less resistance. Example embodiments are not limited to the arrangements and dimensions of the springs as shown in the figures.

As mentioned above, the top part (open top end) of spring 30 slides over and around, and engages with, respective support post 29 extending downward from bottom surface 33 of third portion 26 (top edge extension 23*c*) of cover retaining plate 20. In addition, the bottom part (open bottom end) of spring 30 slides into, and engages with, a respective notch 42 defined in top edge 41 of cutting edge 40, as discussed in further detail below.

Cutting edge 40 is configured to engage with the road surface during operation of the snow plow cutting edge device 8. Cutting edge 40 includes a top edge 41 including notches 42 formed therein, a pair of side edges 47, a pair of elongated openings 48, and a bottom edge 49. Cutting edge 40 may be a relatively short segment of an entire cutting edge assembly for a snow plow, such as a 12 inch segment for example. Cover retaining plate 20 may similarly be a short segment (e.g., about 12 inches) of the entire cutting edge assembly, where each cutting edge attachment 9 includes one cover retaining plate 20 per one cutting edge 40. Thus, each cutting edge attachment 9 is roughly one foot in length, in a non-limiting illustrative example. However, example embodiments are not limited thereto, and each cutting edge 40 may be somewhat shorter or longer in the horizontal direction along the snow plow edge in modified designs. Similarly, example embodiments are not limited to the width of cutting edge 40 in the vertical direction as shown in the figures.

Top edge 41 of cutting edge 40 may be partially flat (or straight) in the horizontal direction, except for notches 42 formed in top edge 41 of cutting edge 40. Notches 42 may be a square or rectangular shape formed by cutting out small sections spaced along top edge 41. Notches 42 may thus include a flat bottom surface 43 and two flat side surfaces 44 that are designed to receive and support springs 30. The bottom part of spring 30 slides into notch 42 and engages with bottom surface 43 of notch 42 to secure spring 30 during assembly of cutting edge attachments 9, while side surfaces 44 of notch 42 prevent lateral movement of spring 30 during operation of the snow plow cutting edge device 8.

Although three notches 42 are shown in the figures, some other example embodiments are not limited thereto, and there may be a greater or lesser number of notches per cutting edge. For example, there may be only two outer notches or a single inner notch, or there may be a pair of inner notches and a pair of outer notches. In the case of fewer than three notches the notches may be wider to accommodate larger springs, and in the case of more than three notches the notches may be narrower to accommodate smaller springs. Example embodiments are not limited to the arrangements and dimensions of the notches as shown in the figures.

Notches 42 in top edge 41 also form inner extensions 45 and outer extensions 46, where inner extensions 45 may be wider/larger and the outer extensions 46 are narrower/smaller compared to each other. Top edge 41 of inner extensions 45 and top edge 41 of outer extensions 46 may lie along the same plane (they are flush or aligned with each other). Likewise, bottom surface 43 of inner notch 42 and the bottom surfaces 43 of outer notches 42 may lie along the same plane (they are flush or aligned with each other). However, other arrangements and dimensions of inner extensions and outer extensions are also possible (e.g., in the alternative embodiments where there are only one or two springs/notches, or where there are four or more springs/notches.

Side edges 47 may be flat (or straight) in the vertical direction in some example embodiments. However, in some other example embodiments, side edges 47 may slope slightly inward from bottom to top in order to reduce or limit friction between cutting edges when one cutting edge retracts more than an adjacent cutting edge, or the adjacent cutting edge does not retract, to adapt to an uneven road surface or other obstacle. This could also permit a slight diagonal rotation allowing one side of cutting edge 40 to move up or down slightly more than the opposite side of the cutting edge. Respective cutting edges 40 of adjacent cutting edge attachments may come into contact with each other once assembled and/or during operation, or there may be a slight gap therebetween to avoid or alleviate friction during movement or retraction of the cutting edge.

Figure 6:
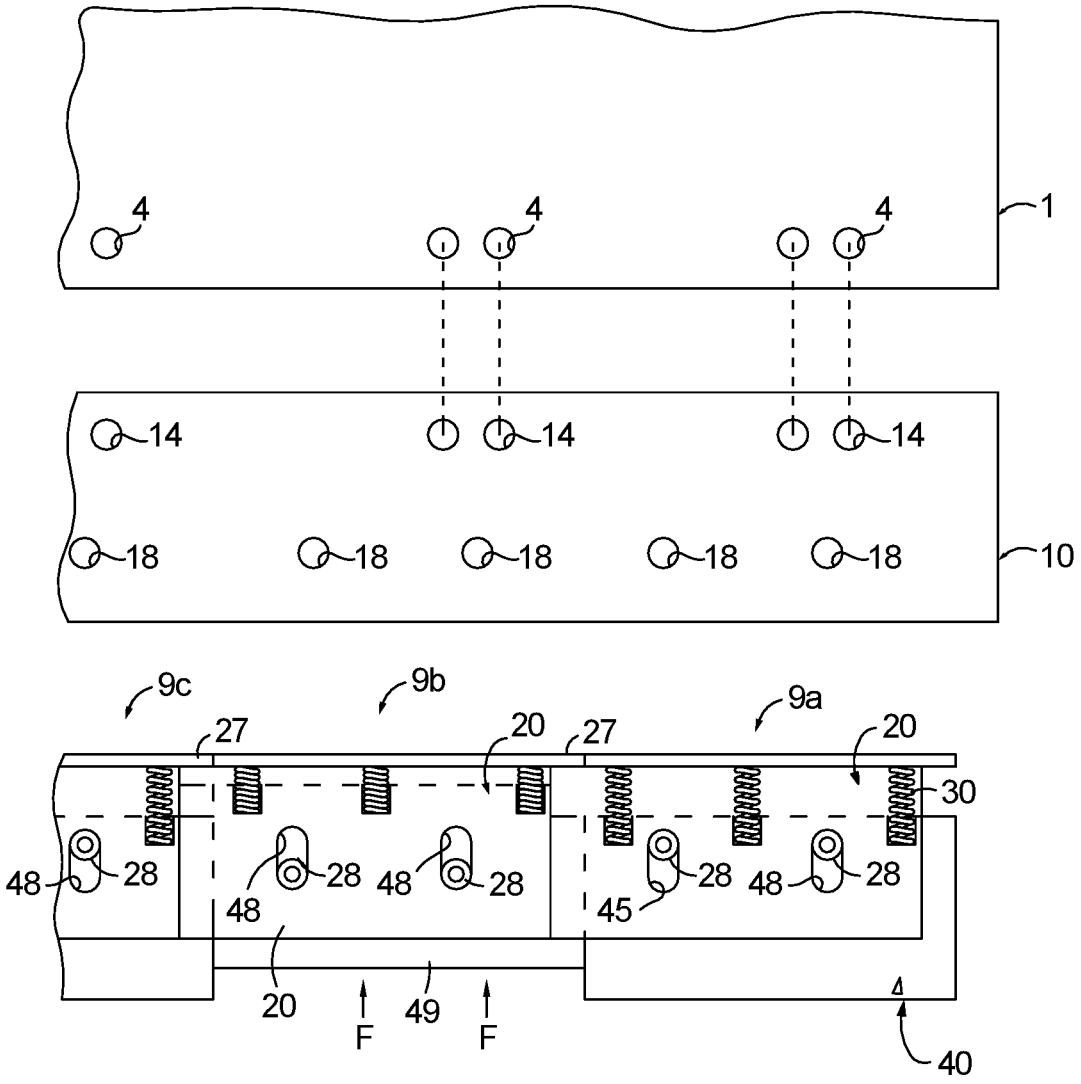
FIG. 6 is an exploded front view of a portion of a snow plow including a plurality of cutting edge attachments showing alignment of respective bolt holes of the adapter plate and cover retaining plate, with one cutting edge in a retracted state or position, according to an example embodiment.

The pair of elongated openings 48 are configured to receive the pair of through-hole bushings 28 of cover retaining plate 20, which are inserted through elongated openings 48 when assembled, in order to allow cutting edge 40 to slidably move up and down (either vertically or on a tilted angle relative to the road surface) guided by through-hole bushings 28 when upward force F is applied to bottom edge 49 of cutting edge 40 during operation (see FIG. 6). Elongated openings 48 define the vertical travel of cutting edge 40. Elongated openings 48 may have a vertical oval or rectangular shape (with or without rounded corners), as shown in FIG. 2.

In some example embodiments, downward movement of cutting edge 40 is limited when top surface 48*a* of elongated opening 48 contacts the through-hole bushing 28, and upward movement of cutting edge 40 is limited when bottom surface 48*b* of elongated openings 48 contacts through-hole bushing 28 (refer to FIGS. 3-4 and 6) during compression of spring 30 when an uneven road surface or other obstacle is encountered.

Further, downward and/or upward movement may be limited by the height and/or the compressive strength of springs 30 and/or the distance of travel between third portion 26 (top edge extension 23*c*) of cover retaining plate 20 and top edge 41 of cutting edge 40. For example, through-hole bushings 28 may or may not actually come into contact with bottom surface 48*b* of cutting edge 40 when an upward force F is applied to bottom edge 49 of cutting edge 40 so as to cause maximum retraction of cutting edge attachment 9. Likewise, top edge 41 of cutting edge 40 may or may not actually come into contact with bottom surface 33 of third part 26 (top edge extension 23*c*) of cover retaining plate 20 when an upward force F is applied to bottom edge 49 of cutting edge 40 so as to cause maximum retraction of the cutting edge attachment.

In some example embodiments, elongated openings 48 at least partially overlap with notches 42 in the vertical direction, as shown in FIG. 2. This is to ensure a more compact design compared to other existing flexible snow plow cutting edge devices. However, elongated openings 48 may overlap with notches 42 to a different or modified degree in some other example designs than shown in FIG. 2, to accommodate different sizes of springs and notches and/or different widths of the cutting edges.

Bottom edge 49 of cutting edge 40 may be flat (or straight) and is the portion of the cutting edge attachment that actually scrapes the snow and/or ice that has accumulated on the road surface during operation of the snow plow cutting edge device. Thus, cutting edge 40, and particularly bottom edge 49 thereof, is the component that is most susceptible to wear and damage over time, due to the various uneven road surfaces and other obstacles that the snow plow may encounter during normal operation.

To address this issue, the design and configuration of the cutting edge attachment 9 (including cover retaining plate 20, springs 30, and cutting edge 40) allows for quick and easy installation and removal as well as low cost repair and/or replacement of individual cutting edges 40, as the need arises. Further, springs 30 have a simple design and are individually replaceable if needed, and do not require a customized retraction mechanism such as flexible elastomeric means with non-standard shapes and/or different widths at different portions and/or different compressive strengths along the length thereof. Therefore, the cutting edge attachment according to example embodiments described herein provides numerous improvements over fixed cutting edges, non-modular designs, and complicated or custom-designed flexible mechanisms or components that may permit retraction of cutting edges in some form.

Also, the plurality of cutting edge attachments of the snow plow cutting edge device according to example embodiments described herein provide a further advantage over existing snow plow cutting edge devices in that the respective springs 30 of each cutting edge attachment can compress and expand independently of springs of other cutting edge attachments of the snow plow cutting edge device, such that each cutting edge can adapt independently to varying road conditions along the length of the snow plow moldboard 1 and adapter plate 10 as the snow plow encounters uneven road surfaces and other obstacles during normal operation.

Furthermore, the design of the snow plow cutting edge device allows each individual cutting edge attachment 9 to be removed and repaired or replaced if needed, as parts become worn or damaged. Similarly, each individual cover retaining plate 20 and/or each individual cutting edge 40 may be easily removed and replaced as needed (e.g., in 12 inch or sections of about one foot in length), without requiring any disassembly or replacement of the other cutting edge attachments and cutting edges of the snow plot cutting edge device (e.g., loosening or removing bolts of neighboring blade sections to pry out one section is not needed). Thus, the modular design of the cutting edge attachments 9 allows individual sections to easily and quickly be changed out without disturbing adjacent sections of the snow plow cutting edge device.

Figure 3:
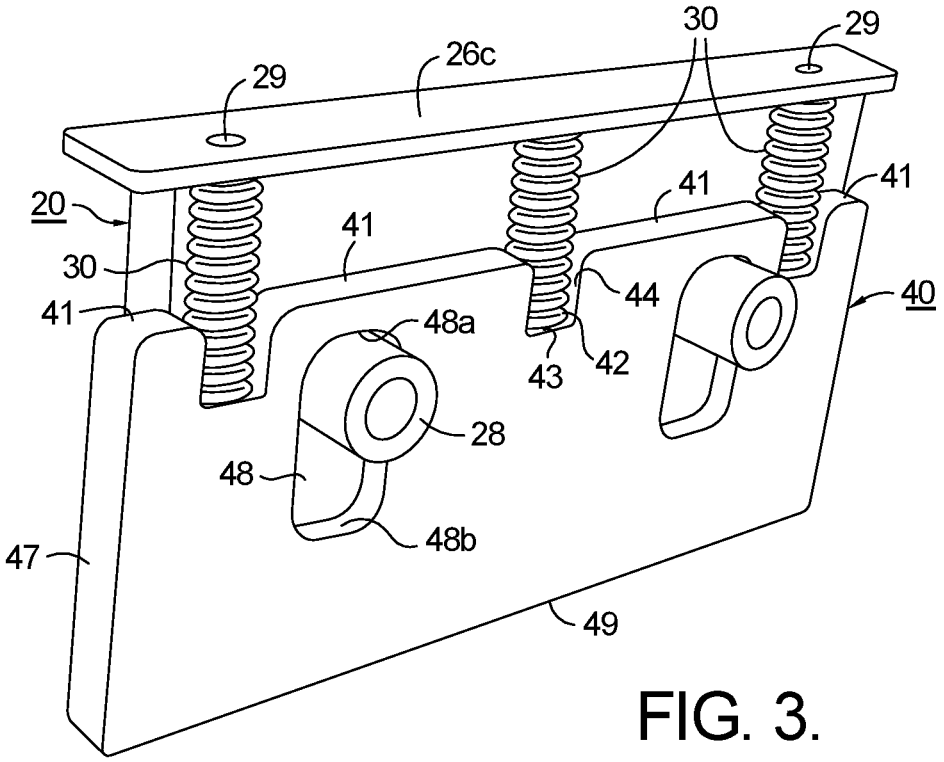
FIG. 3 is a rear perspective view of a single cutting edge attachment once assembled, according to an example embodiment.

FIG. 3 is a rear perspective view of a single cutting edge attachment 9 once assembled, according to an example embodiment. As shown in FIG. 3, springs 30 are in a decompressed state and through-hole bushings 28 of cover retaining plate 20 are in contact with top surface 48*a* of elongated openings 48 of cutting edge 40. The may be considered the default state or position of the cutting edge attachment, when no upward force F is being applied to bottom edge 49 of cutting edge 40.

As the cutting edge attachments encounter uneven road surfaces or other obstacles during normal operation of the snow plow cutting edge device, through-hole bushings 28 may slide within through-holes 28. Springs 30 may transition to a decompressed state and the through-hole bushings 28 of the cover retaining plate 20 may come into contact with bottom surface 48*b* of elongated openings 48 of cutting edge 40. This may be considered the maximum retraction state or position of the cutting edge attachment 9, when an upward force F is being applied to bottom edge 49 of cutting edge 40. FIG. 6 illustrates the retraction of one cutting edge 40 of an individual cutting edge attachment 9*a* relative to the non-retraction of adjacent cutting edges 40 of another other cutting edge attachment 9*b* of the snow plow cutting edge device 8. Also refer to FIG. 11 for another detailed view of the cutting edge attachment according to example embodiments.

Figure 4:
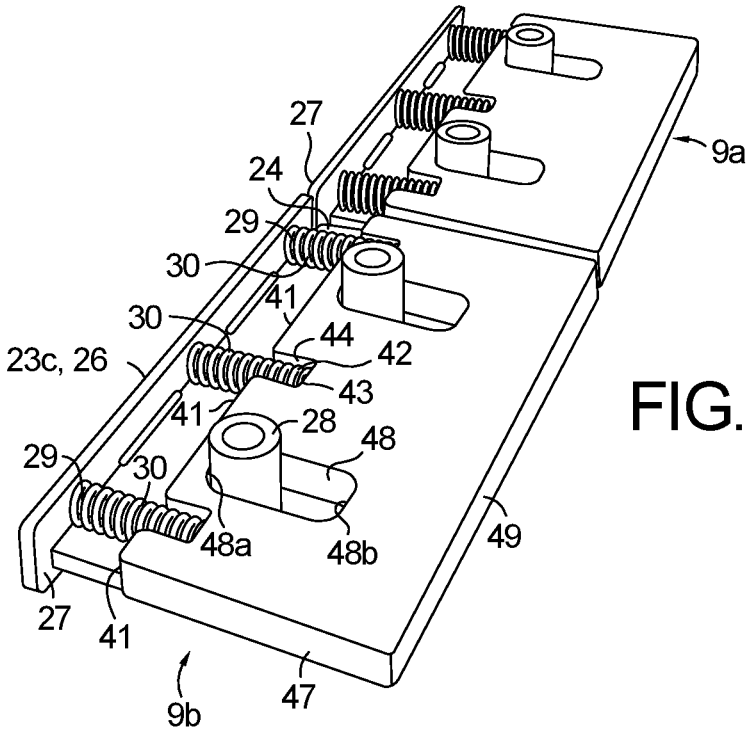
FIG. 4 is a rear perspective view of a pair of adjacent cutting edge attachments once assembled and aligned, according to an example embodiment.

FIG. 4 is a rear perspective view of a pair of adjacent cutting edge attachments 9 once assembled and aligned, according to an example embodiment. Similar to FIG. 3, FIG. 4 shows an assembled cutting edge attachment 9 but from a different angle. Additionally, FIG. 4 illustrates the modular design of the plurality of cutting edge attachments of the snow plow cutting edge device according to example embodiments described herein. A pair of adjacent cutting edge attachments 9 may partially overlap with each other when they are aligned, such as when being mounted to adapter plate 10 during installation. For example, first extension 27 of first cover retaining plate 20 of a first cutting edge attachment 9*a* overlaps with second extension 24 of a second cover retaining plate 20 of a second cutting edge attachment 9*b* that is aligned with an adjacent to the first cutting edge attachment 9*a*, and so on along the length of adapter plate 10 and snow plow moldboard 1 once all of the components of the snow plow cutting edge device 8 are mounted together. Thus, extension 27 of cover retaining plate 20 of one cutting edge attachment 9*a* may overlay a portion of cutting edge 40 (e.g., an outer extension 46 of a top edge 41) of another adjacent cutting edge attachment 9*b*. This overlapping cover retaining plate feature assists with installation and removal of the individual cutting edge attachments, for example. While FIGS. 2-4 show a rear view of the cutting edge attachments including cover retaining plate 20, springs 30, and cutting edge 40, also refer to FIGS. 5-6 for a front view of the assembled cutting edge attachments of FIGS. 2-4.

Figure 5:
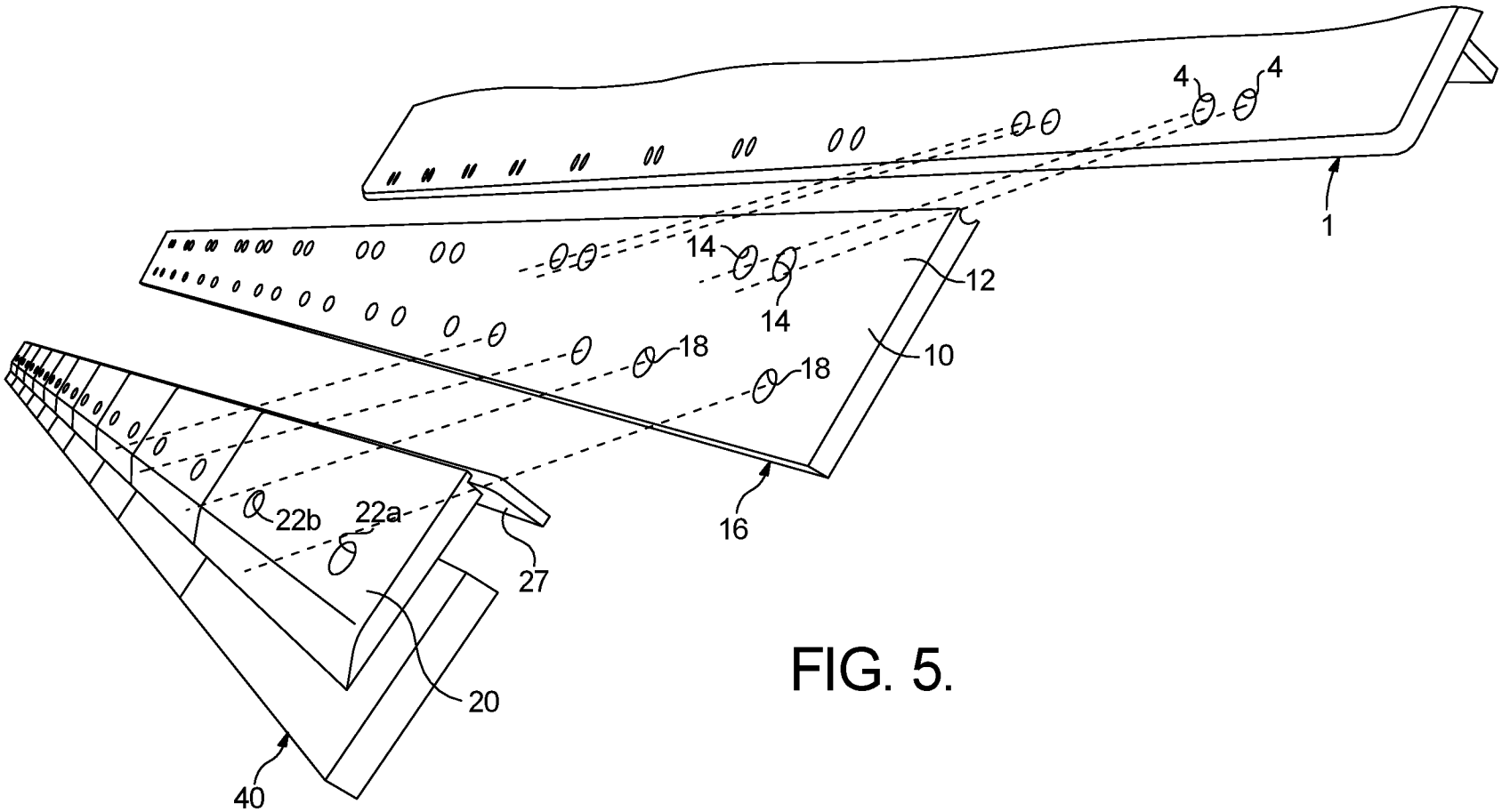
FIG. 5 is an exploded perspective view of a snow plow cutting edge device including a plurality of cutting edge attachments showing alignment of respective bolt holes of the adapter plate and the cover retaining plates of the cutting edge attachments, according to an example embodiment.

FIG. 5 is an exploded perspective view of a snow plow cutting edge device including a plurality of cutting edge attachments 9 showing alignment of respective bolt holes of the adapter plate and cover retaining plate, according to an example embodiment. FIG. 5 is similar to FIG. 1, but shows the cutting edge attachments 9 (including cover retaining plate 20, springs 30, and cutting edge 40) separated from adapter plate 10 and plow moldboard 1. The configuration of holes 4 in the moldboard 1 may be standard existing configurations, and holes 14 in adapter plate 10 may align with holes 4 to enable snow plow cutting edge device 8 according to example embodiments to be utilized without modification to moldboard 1 (as well as the rest of the snow plow not shown in the figures). The configuration of holes 18 in the adapter plate may align with the through-hole bushings 28 and elongated openings 48 to enable the individual cutting edge attachments according to example embodiments to be installed and removed independently of the other cutting edge attachments.

The distances between individual holes or pairs of holes (4/14) may be different from the distances between individual holes or pairs of holes (18/28/48). There may be a greater or lesser number of holes 4/14 and/or holes 18/28/48 total than shown in the figures (e.g., depending on how many cutting edge attachments are needed to correspond to the length of the existing snow plow moldboard 1 and the adapter plate 10). Also, there may be a greater or lesser number of holes 4/14 and/or holes 18/28/48 compared to each other than shown in the figures.

FIG. 6 is an exploded front view of a portion of a snow plow including a plurality of cutting edge attachments showing alignment of respective bolt holes of the adapter plate and the cover retaining plates of the cutting edge attachments, with one cutting edge in a retracted state or position, according to an example embodiment. FIG. 6 is similar to FIG. 5, showing the corresponding alignments of respective bolt holes of the various components of the snow plow cutting edge device from a different angle, but further shows cutting edge 40 of one of the cutting edge attachments in the retracted state or position, which is caused by an upward force F being exerted on the bottom edge 41 of cutting blade 40 (e.g., resulting from an uneven road surface or other obstacle in the road during normal operation).

Portions of the cutting edge attachments 9 that are obscured from the front view of FIG. 6, such as springs 30 and the majority of cutting edges 40 including top edge 41 and elongated openings 48, are shown with broken lines in FIG. 6 (refer to FIGS. 2-4). As shown in FIG. 6, springs 30 of one of the cutting edge attachments are compressed, and the position of top edge 41 and bottom edge 49 of cutting edge 40 of that cutting edge attachment 9*a* have moved upward in the vertical direction, compared to the respective components of the adjacent cutting edge attachments 9*b*, 9*c*. As mentioned above, movement of cutting edges 40 in the vertical direction may be controlled or limited when through-hole bushings 28 of the cover retaining plates 20 come into contact with bottom surface 48*b* and/or top surface 48*a* of the elongated openings 48 of cutting edges 40 as different forces are encountered on road surfaces during operation, for example.

Thus, each of cutting edges 40 of each individual cutting edge attachment are slidably movable, along through-hole bushings 28 within elongated openings 48, to and from the retracted state or position, independently of other cutting edges 40 of neighboring cutting edge attachments. Similarly, each set of springs 30 of each individual cutting edge attachment 9 are compressible independently of other sets of springs of neighboring cutting edge attachments. These features help the snow plow cutting edge device to be able to better adapt to varying road conditions with its modular cutting edge attachment design.

Furthermore, each cutting edge 40 and/or other components of the cutting edge attachments are installable/removable and repairable/replaceable independently of other cutting edge attachments 40 and components thereof. This helps to reduce maintenance time and lower costs, and thereby increase overall operator satisfaction with the improved snow plow cutting edge device.

Figure 7A:
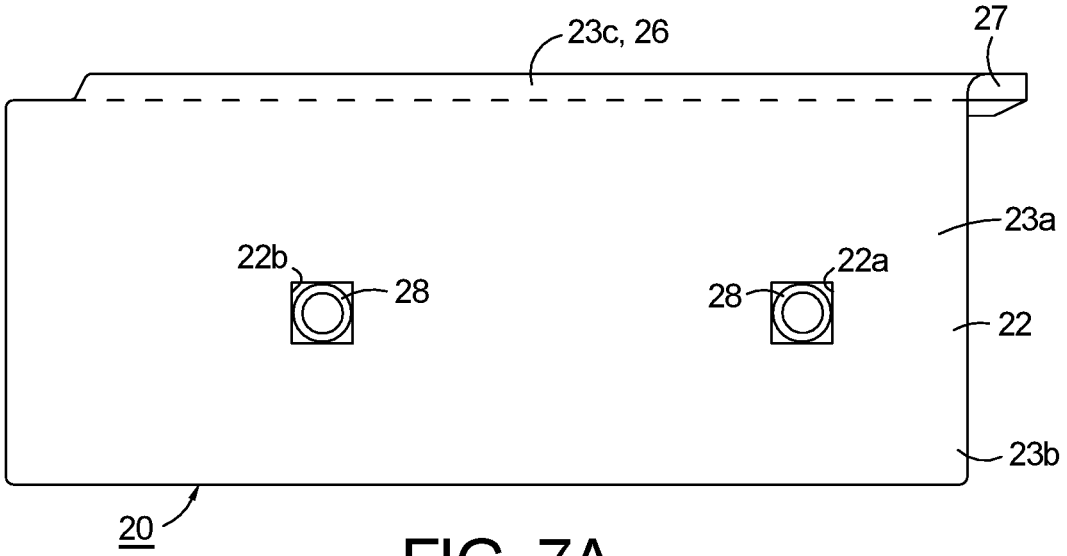
FIGS. 7A and 7B show a front view and a perspective view of the front side of the cover retaining plate of a cutting edge attachment, according to an example embodiment.
Figure 7B:
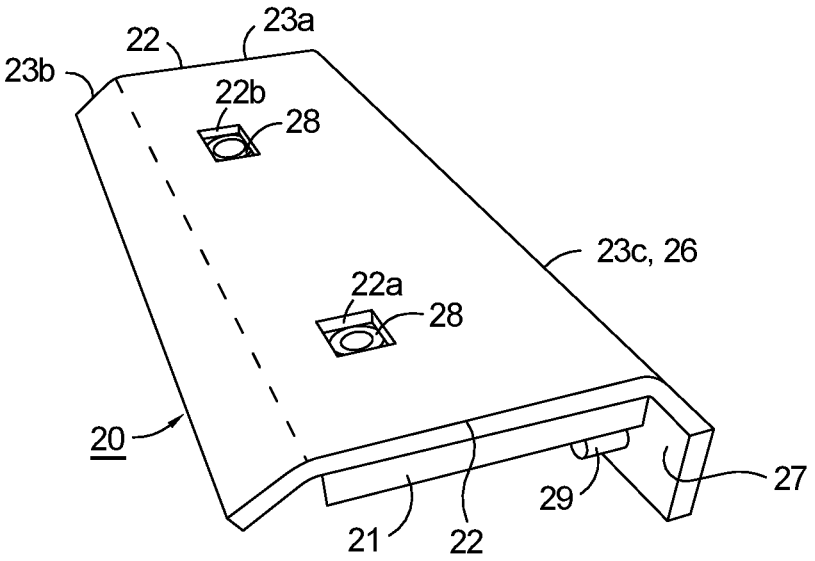

FIGS. 7A and 7B show a front view and a perspective view of the front side of the cover retaining plate of a cutting edge attachment, according to an example embodiment. As shown in FIGS. 7A and 7B, cover retaining plate 20 includes first portion 21, second portion 22 (including middle section 23*a* and bottom section 23*b*), and third portion 26 (or top edge extension 23*c*) including extension 27. First portion 21 and second portion 22 include bolt holes 21*a*, 21*b* and 22*a*, 22*b*, respectively. In some example embodiments, these bolt holes may form countersunk square holes for receiving the through-hole bushings 28, and preventing or limiting the heads of the through-hole bushings 28 from rotating or turning when fully inserted (such as when installing the corresponding bolts 25 into through-hole bushings 28 to attach cutting edge attachment 9 to adapter plate 10).

Figure 8A:
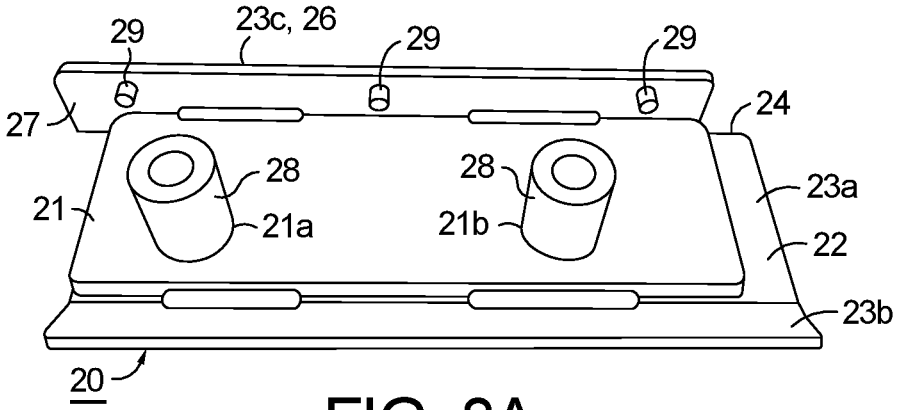
FIGS. 8A and 8B show a rear view and a perspective view of the back side of the cover retaining plate of a cutting edge attachment, according to an example embodiment.
Figure 8B:
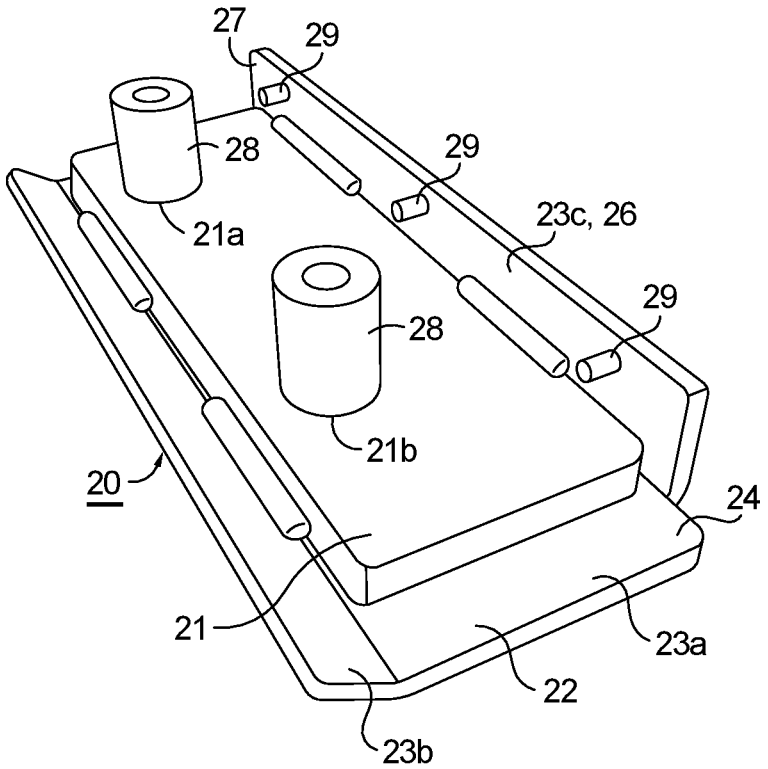

FIGS. 8A and 8B show a rear view and a perspective view of the back surface of the cover retaining plate of a cutting edge attachment, according to an example embodiment. As shown in FIGS. 8A and 8B, cover retaining plate 20 includes first portion 21, second portion 22 (including middle section 23*a* and bottom section 23*b*, forming extension 24), and third portion 26 (or top edge extension 23*c*) including extension 27. First portion 21, second portion 22, and third portion 26 may be welded together to form cover retaining plate 20. Through-hole bushings 28 are also shown inserted through bolt holes 22*a*, 22*b* of second portion 22 and bolt holes 21*a*, 21*b* of first portion 21. Third portion 26 (or top edge extension 23*c*) includes support posts 29 extending downward therefrom, for engaging with springs 30 when assembled.

Figure 9A:
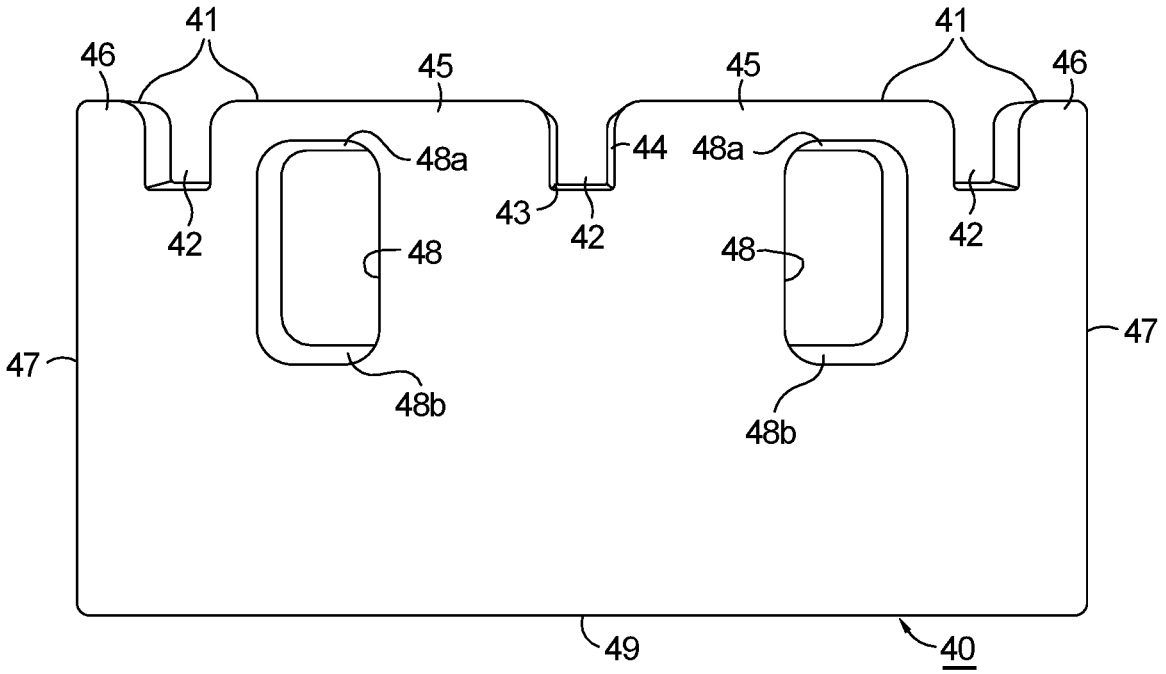
FIGS. 9A and 9B show a front view and a perspective view of the cutting edge of the cutting edge attachment, according to an example embodiment.
Figure 9B:
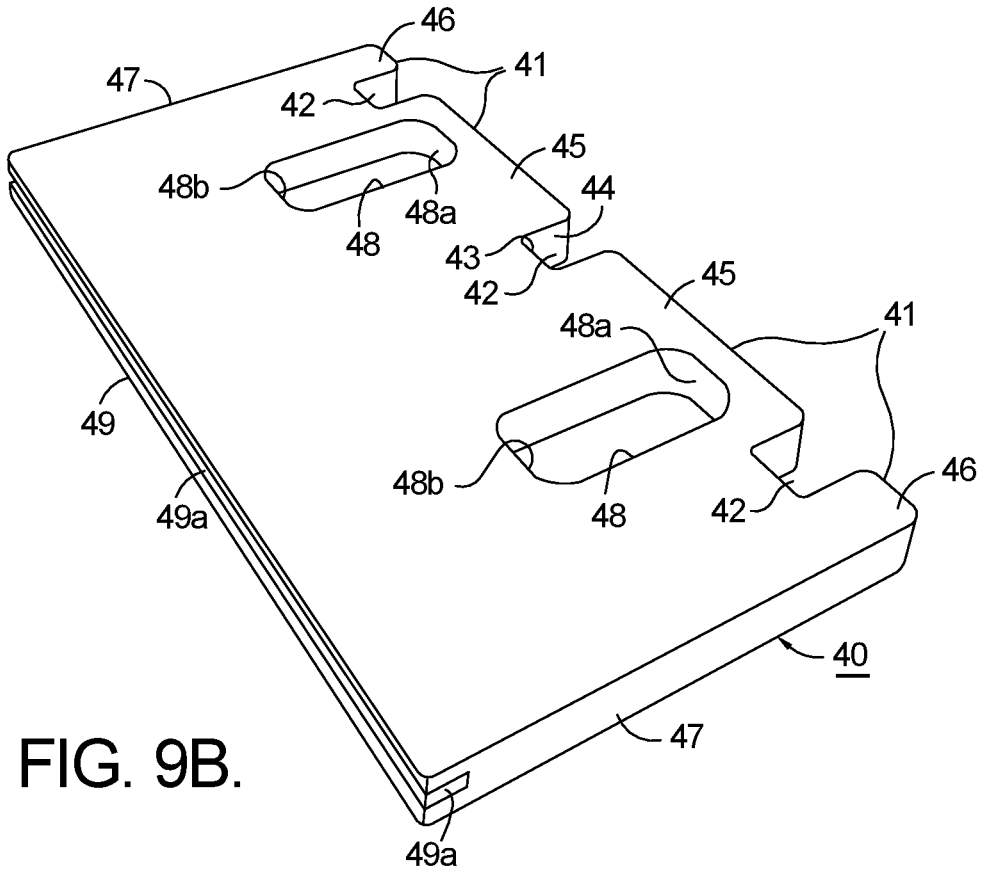

FIGS. 9A and 9B show a front view and a perspective view of the cutting edge 40 of the cutting edge attachment 9, according to an example embodiment. As shown in FIGS. 9A and 9B, cutting edge 40 includes top edge 41, side edges 47, and bottom edge 49. Top edge 41 may include notches 42, wherein each notch 42 includes a bottom 43 and two sides 44 for receiving and supporting springs 30. Notches 42 in top edge 41 may form inner extensions 45 and outer extensions 46. In some example embodiments, cutting edge 40 may have an insert 49*a* (e.g., a carbide insert) affixed to, defined in, or positioned in a channel disposed in, bottom edge 49, as best seen in FIG. 9B. Cutting edge 40 also includes elongated openings 48 including top surface 48*a* and bottom surface 48*b*. During assembly, through-hole bushings 28 of cover retaining plate 20 are inserted through elongated openings 48 of cutting edge 40. During operation, as springs 30 compress in the vertical direction due to an upward force F applied to bottom edge 49 of cutting edge 40, the distance of travel (or retraction) of cutting edge 40 along through-hole bushings 28 may be limited by top surface 48*a* and bottom surface 48*b* of elongated openings 48, according to some example embodiments.

Figure 10A:
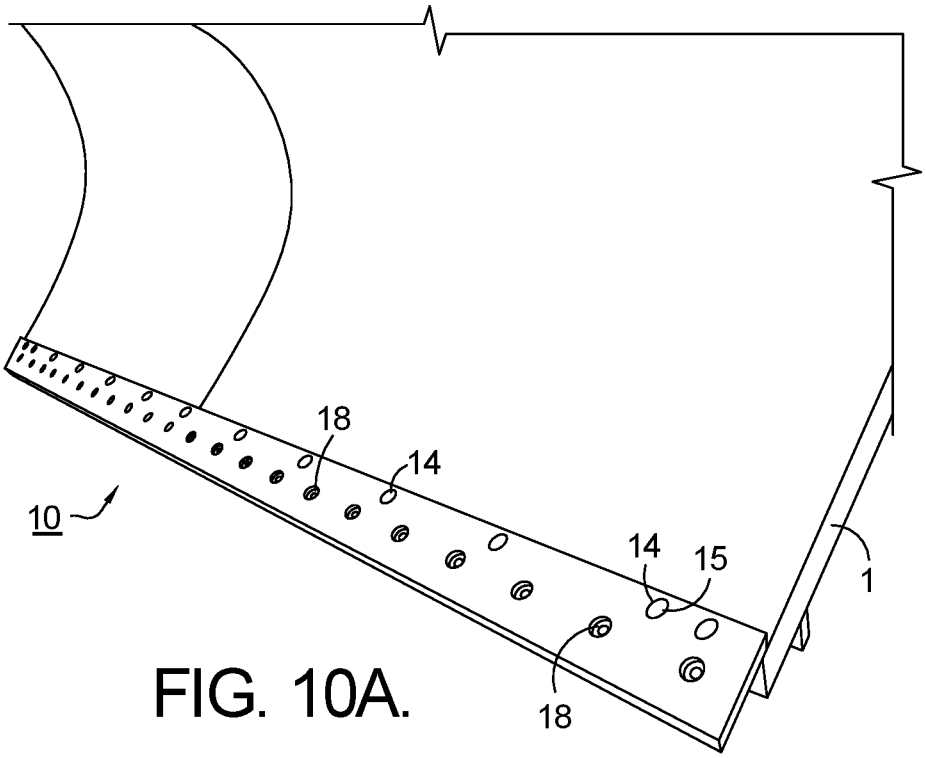
FIGS. 10A and 10B show a front view and a perspective view of the adapter plate of the snow plow cutting edge device, according to an example embodiment.
Figure 10B:
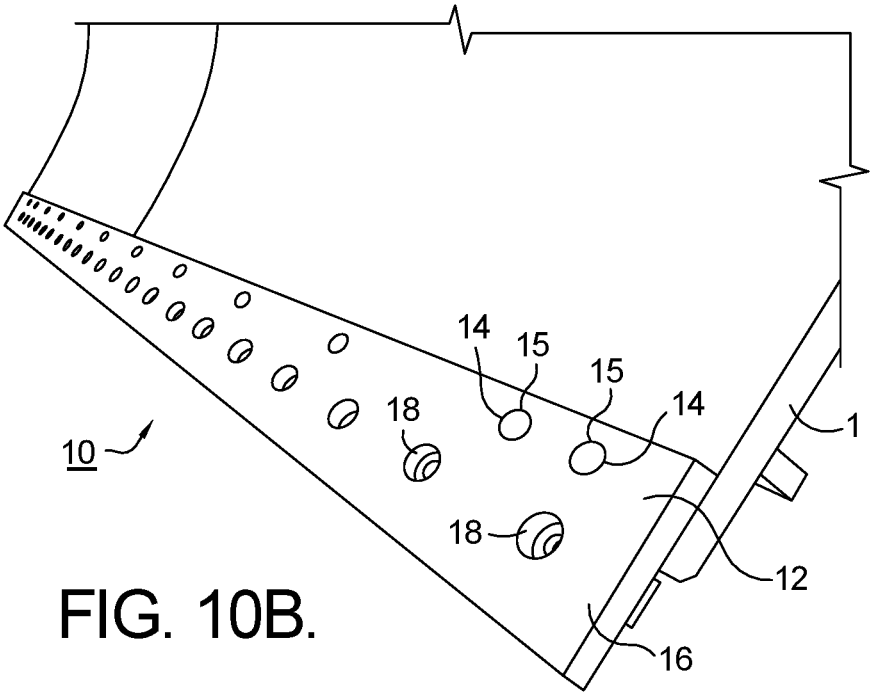

FIGS. 10A and 10B show a front view and a perspective view of the adapter plate of the snow plow cutting edge device, according to an example embodiment. As shown in FIGS. 10A and 10B, adapter plate 10 includes bolt holes 14 for attaching adapter plate 10 to plow moldboard 1, and bolt holes 18 for attaching the cutting edge attachment (including cover retaining plate 20, springs 30, and cutting edge 40) to adapter plate 10. The length of adapter plate 10 and the number of bolt holes 14, 18 shown in the figures is not limiting, and many other configurations are possible depending on the size/width of the snow plow itself, for example.

During assembly, the cutting edge attachments may be mounted onto snow plow moldboard 1 via adapter plate 10 by inserting through-hole bushings 28 of cover retaining plate 20 through bolt holes 18 of adapter plate 10, and securing cover retaining plate 20 to adapter plate 10 by installing bolts 25 in through-hole bushings 28. Each cutting edge attachment may be installed onto and removed from adapter plate 10 individually (independent of other cutting edge attachments). Each cutting edge 40 may operate (move vertically, retract) independently of other cutting edges 40 along the length of the adapter plate 10.

Figure 11:
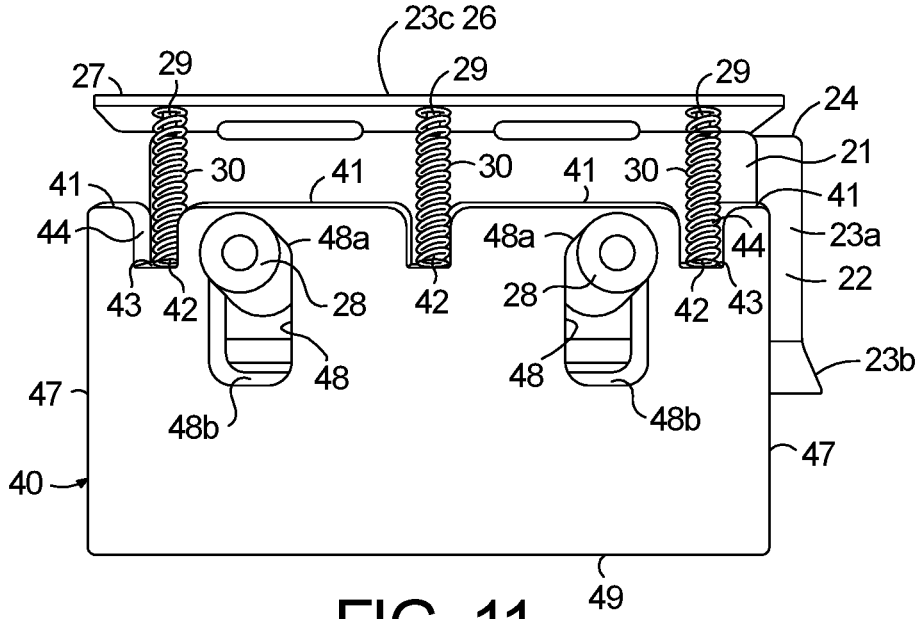
FIG. 11 is a rear view of the back side of an assembled cutting edge attachment, according to an example embodiment.

FIG. 11 is a rear view of the back side of an assembled cutting edge attachment, according to an example embodiment. Similar to FIG. 3 above, FIG. 11 shows an assembled cutting edge attachment including cover retaining plate 20, springs 30, and cutting edge 40, with the springs installed between third portion 26 (top edge extension 23*c*) of cover retaining plate 20 and notches 42 in top edge 41 of cutting edge 40.

During assembly, springs 30 are installed such that the bottom part of springs 30 are inserted into and are surrounded by bottom surface 43 and side surfaces 44 of notches 42, and the top part of the springs 30 are inserted onto and surround support posts 29. As shown in FIG. 11, once springs 30 are installed, the compressive strength of springs 30 will bias through-hole bushings 28 against top surface 48*a* of cutting edge 40. Springs 30 are capable of compressing in the vertical direction, and cutting edge 40 is capable of sliding along through-hole bushings 28 in the vertical direction (or at a tilted angle).

During operation, when an upward force F is applied to bottom edge 49 of cutting edge 40, springs 30 will compress and cutting edge 40 will slide along through-hole bushings 28 in the vertical direction, with maximum retraction being limited by through-hole bushings 28 coming into contact with bottom surface 48*b* of elongated openings 48 of cutting edge 40, according to some example embodiments.

Additionally or alternatively, the maximum retraction of cutting edge 40 could also be limited by the size or strength of springs 30, or by top edge 41 of cutting edge 40 coming into contact with bottom side of third portion 26 (top edge extension 23*c*) of cover retaining plate 20.

Figure 12:
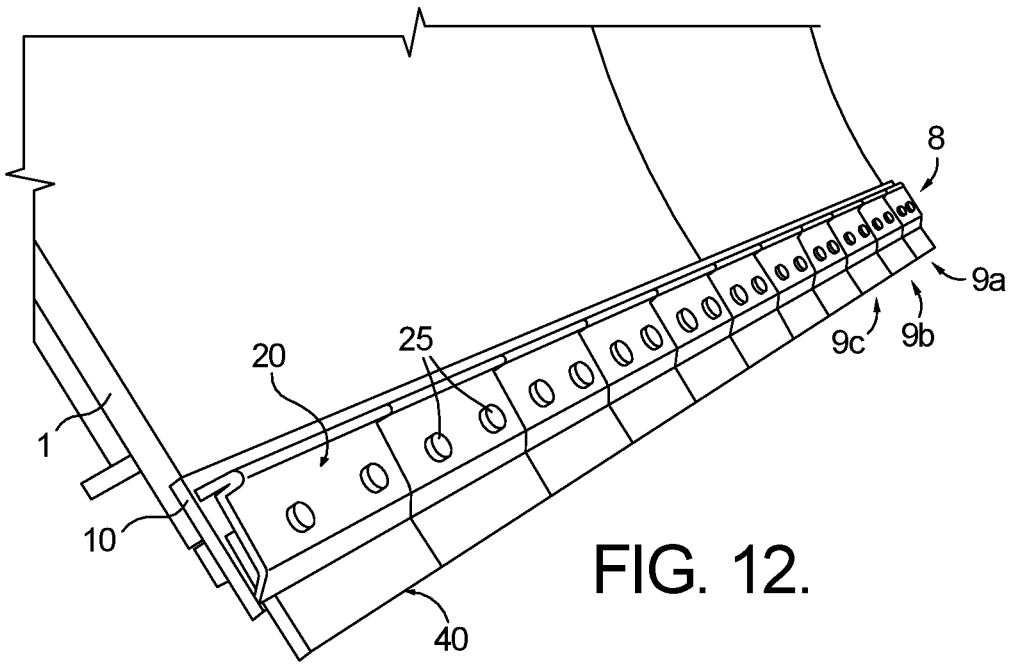
FIG. 12 is another front perspective view of a snow plow cutting edge device including a plurality of cutting edge attachments, according to an example embodiment.

FIG. 12 is another front perspective view of a snow plow cutting edge device 8 including a plurality of cutting edge attachments 9, according to an example embodiment. Similar to FIG. 1 above, FIG. 12 shows a plurality of cutting edge attachments 9 each including cover retaining plate 20, springs 30, and cutting edge 40, which can be individually installed onto or removed from adapter plate 10 that is mounted to moldboard 1 of a snow plow. Each cutting edge 40 of each cutting edge attachment is configured to retract (slidably move in the vertical direction or at a tilted angle relative to the road surface) independently of other cutting edges 40 of the other cutting edge attachments 9 that are mounted to snow plow moldboard 1 via adapter plate 10. Although FIG. 1 shows that top portion 12 of adapter plate 10 can be left exposed after cutting edge attachments 9 are installed, thereby providing access to bolts 15 securing adapter plate 10 to moldboard 1, FIG. 12 shows that the cutting edge attachments 9 may actually cover the top portion 12 and bolts 15 of adapter plate 10 when installed, according to another example embodiment. This modification frees up space to allow springs 30 to have more room while not making the overall snow plow blade system too tall, which provides enhanced flexibility in a tight space as well as increases strength because the cutting edge attachments 9 will have more of adapter plate 10 behind them for increased support during operation.

Once installed, a plurality of cutting edge attachments 9 are aligned in a row across the length of adapter plate 10. Cover retaining plates 20 partially overlap with adjacent cover retaining plates 20, where extension 27 at the end of third portion 26 (or top edge extension 23*c*) of one cover retaining plate 20 meets extension 24 at the opposite end of second portion 22 (middle section 23*a* and bottom section 23*b*) of another cover retaining plate 20 that is adjacent thereto.

Cutting edges 40 are supported between adapter plate 10 on one side (the back side) and cover retaining plate 20 on the other side (front side). Thus, horizontal movement of cutting edge 40 is limited by adapter plate 10 and cover retaining plate 20. On the other hand, vertical movement of cutting edge 40 is limited by the compressive strength of springs 30, and the positional relationship between through-hole bushings 28 and top surface 48*a* and bottom surface 48*b* of elongated openings 48 of cutting edge 40.

During operation of the snow plow cutting edge device 8, each cutting edge 40 of each of the plurality of cutting edge attachments 9 can retract at different times and to different degrees in order to adapt to varying forces F that are caused by non-level road surfaces and road obstacles, for example. In addition to being a compact design with relatively few components and moving parts, the specific design of cover retaining plate 20 and cutting edge 30 and their interactions with each other and the springs 30 is particularly unique compared to existing snow plow designs with a flexing feature or retracting capability.

As described above with reference to FIGS. 1-12, the snow plow cutting edge device 8 and cutting edge attachments 9 enable improved engagement with uneven road surfaces and adaptation to obstacles in the road, which results in more effective removal of snow and ice from road surfaces. Example embodiments described herein also reduce the maintenance times and costs of repair or replacement in the event of worn or damaged cutting edges or other components, and have a modular configuration allowing for easy installation and removal, which can improve operator satisfaction with the overall performance of the snow plow cutting edge device. The cover retaining plate and the cutting edge of the cutting edge attachments also have unique designs, configurations, shapes, and/or arrangements compared to existing snow plow cutting edge devices, regardless of whether their corresponding cutting edge is fixed or includes multiple flexible or retractable elements.

From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A snow plow cutting edge device for use with a snow plow, wherein the snow plow includes a moldboard, the snow plow cutting edge comprising:

an adapter plate configured to mount to the moldboard of the snow plow, wherein the adapter plate includes a plurality of apertures defined therein;

a plurality of cutting edge attachments, wherein each of the cutting edge attachments include a cover retaining plate, a plurality of springs, and a cutting edge; and a plurality of fasteners for attaching each of the plurality of cutting edge attachments to the adapter plate, wherein the cover retaining plate includes a back plate, a top edge extension, and a pair of through-hole bushings extending outward from the back plate, wherein the cutting edge includes a pair of elongated openings defined therein, wherein each of the elongated openings receive one of the pair of through-hole bushings, wherein a plurality of notches are defined in a top edge of the cutting edge, wherein each of the plurality of notches include a bottom surface and two opposing side surfaces that are configured to receive a corresponding one of the plurality of springs, wherein the cutting edge includes a bottom edge configured for engaging a road surface during operation of the snow plow, wherein each of the plurality of springs include a first end and a second end, wherein the first end is engaged with the bottom surface of a corresponding one of the plurality of notches, wherein each of the plurality of springs have a width that corresponds to a width between the two opposing side surfaces of the corresponding one of the plurality of notches to prevent lateral movement of the corresponding one of the plurality of springs relative to the cutting edge, and wherein the second end is disposed against the top edge extension of the cover retaining plate, wherein each of the plurality of fasteners are disposed in one of the pair of through-hole bushings and a corresponding one of the plurality of apertures defined in the adapter plate to secure the respective cutting edge attachment to the adapter plate, and wherein the pair of through-hole bushings are positioned within the corresponding elongated pair of elongated openings defined in the cutting edge so that the cutting edge is movably secured between the cover retaining plate and the adapter plate, and wherein the plurality of springs bias the cutting edge toward the road surface so that the bottom edge of the cutting edge maintains contact with the road surface.

2. The snow plow cutting edge device of claim 1, wherein the cutting edges for each of the plurality of cutting edge attachments are configured for moving independent of one another.

3. The snow plow cutting edge device of claim 1, wherein the back plate includes: a first portion that is a flat plate including a pair of holes defined therein which are configured to receive the pair of through-hole bushings; and a second portion including a flat middle section and an angled bottom section, wherein a pair of holes are defined in the middle section that are aligned with the pair of through-hole bushings, and wherein the pair of through-hole bushings protrude outward from the back surface of the second portion, wherein the top edge extension is disposed at an angle relative to the first portion and the middle section of the second portion.

4. The snow plow cutting edge device of claim 3, wherein the top edge extension is integrated with the second portion such that the top edge extension is a top section of the second portion; or the top edge extension is a separate and distinct plate relative to the first and second portions of the cover retaining plate.

5. The snow plow cutting edge device of claim 3, wherein the first portion includes a first end and a second end, and wherein the second portion of the cover retaining plate includes a first side extension that protrudes outwardly from the first end of the first portion of the cover retaining plate, and wherein the top edge extension includes a second side extension that protrudes outwardly from the second end of the first portion.

6. The snow plow cutting edge device of claim 5, wherein the first side extension of the second portion is configured to overlap with the second side extension of the top edge extension of another cover retaining plate of another cutting edge attachment that is adjacent to the respective cutting edge attachment.

7. The snow plow cutting edge device of claim 1, wherein each of the plurality of notches have a similar configuration.

8. The snow plow cutting edge device of claim 1, wherein the top edge extension includes a bottom surface, and wherein the top edge extension includes a plurality of support posts extending downward from the bottom surface, and wherein each of the plurality of support posts are disposed in a corresponding one of the plurality of springs.

9. The snow plow cutting edge device of claim 1, wherein the cutting edge of at least one of the plurality of cutting edge attachments includes first and second opposing side edges, wherein at least one of the first and second opposing side edges is unrestricted thereby allowing the plurality of springs for each of the plurality of cutting edge attachments to operate independently relative to one another.

10. A cutting edge attachment for connection to an adapter plate mountable to a moldboard of a snow plow, the cutting edge attachment comprising:

a cover retaining plate including a back plate, a top edge extension, and a pair of through-hole bushings extending outward from the back plate;

a plurality of springs, wherein each spring includes a first end and a second end, wherein the first end of each of the plurality of springs is disposed against the top edge extension of the cover retaining plate; and a cutting edge including:

a pair of elongated openings defined therein, wherein each of the elongated openings receive one of the through-hole bushings, a top edge having a plurality of notches defined therein, wherein each of the plurality of notches include a bottom surface and two opposing side surfaces that are configured to receive a corresponding one of the plurality of springs, wherein the second end of each of the plurality of springs is engaged with the bottom surface of a corresponding one of the plurality of notches, wherein each of the plurality of springs have a width that corresponds to a width between the two opposing side surfaces of the corresponding one of the plurality of notches to prevent lateral movement of the corresponding one of the plurality of springs relative to the cutting edge, and a bottom edge configured for engaging a road surface during operation of the snow plow, wherein the pair of through-hole bushings are configured for receiving a corresponding number of fasteners that operate to secure the cutting edge attachment to the adapter plate so that the cutting edge is movably secured between the cover retaining plate and the adapter plate, and wherein the plurality of springs bias the cutting edge toward the road surface so that the bottom edge of the cutting edge maintains contact with the road surface.

11. The snow plow cutting edge attachment of claim 10, wherein the back plate includes:

a first portion that is a flat plate including a pair of holes defined therein which are configured to receive the pair of through-hole bushings;

a second portion including a flat middle section and an angled bottom section, wherein a pair of holes are defined in the middle section that are aligned with the pair of through-hole bushings, and wherein the pair of through-hole bushings protrude outward from the back surface of the second portion, wherein the top edge extension is disposed at an angle relative to the first portion and the middle section of the second portion.

12. The snow plow cutting edge attachment of claim 11, wherein the top edge extension is integrated with the second portion such that the top edge extension is a top section of the second portion; or the top edge extension is a separate and distinct plate relative to the first and second portions of the cover retaining plate.

13. The snow plow cutting edge attachment of claim 11, wherein the first portion includes a first end and a second end, and wherein the second portion of the cover retaining plate includes a first side extension that protrudes outwardly from the first end of the first portion of the cover retaining plate, and wherein the top edge extension includes a second side extension that protrudes outwardly from the second end of the first portion.

14. The snow plow cutting edge attachment of claim 13, wherein the first side extension of the second portion is configured to overlap with the second side extension of the top edge extension of another cover retaining plate of another cutting edge attachment that is adjacent to the respective cutting edge attachment.

15. The snow plow cutting edge attachment of claim 10, wherein each of the plurality of notches have a similar configuration.

16. The snow plow cutting edge attachment of claim 10, wherein the top edge extension includes a bottom surface, and wherein the top edge extension includes a plurality of support posts extending downward from the bottom surface, and wherein each of the plurality of support posts are disposed in a corresponding one of the plurality of springs.

17. The cutting edge attachment of claim 10, further comprising first and second opposing side edges, wherein at least one of the first and second opposing side edges is unrestricted thereby allowing the plurality of springs to operate independently relative to one another.

18. A cutting edge for a cutting edge attachment that is adapted to be connected to an adapter plate mountable to a moldboard of a snow plow, wherein the cutting edge attachment includes a cover retaining plate including a back plate, a top edge extension, and a pair of through-hole bushings extending outward from the back plate, and wherein the cutting edge attachment further includes at least two springs, wherein each of the at least two springs include a first end and a second end, wherein the first end of each of the at least two springs is disposed against the top edge extension of the cover retaining plate, the cutting edge comprising:

a pair of elongated openings defined therein, wherein each of the elongated openings receive one of the through-hole bushings, wherein the pair of through-hole bushings are configured for receiving a corresponding number of fasteners that operate to movably secure the cutting edge between the cover retaining plate and the adapter plate;

a top edge having at least two notches defined therein, wherein each of the at least two notches include a bottom surface and two opposing side surfaces that are configured to receive a corresponding one of the at least two springs, wherein the second end of each of the at least two springs is engaged with the bottom surface of a corresponding one of the at least two notches, wherein each of the at least two springs have a width that corresponds to a width between the two opposing side surfaces of the corresponding one of the at least two notches to prevent lateral movement of the corresponding one of the at least two springs relative to the cutting edge; and a bottom edge configured for engaging a road surface during operation of the snow plow, wherein the at least two springs bias the cutting edge toward the road surface so that the bottom edge of the cutting edge maintains contact with the road surface.

19. The cutting edge of claim 18, wherein the at least two notches are either square or rectangular notches.

20. The cutting edge of claim 18, wherein the at least two notches include a first notch, a second notch, and a third notch.

* * * * *